US007277103B2

(12) United States Patent
Kurumisawa et al.

(10) Patent No.: US 7,277,103 B2
(45) Date of Patent: Oct. 2, 2007

(54) IMAGE DISPLAY DEVICE, IMAGE DISPLAY METHOD, AND IMAGE DISPLAY PROGRAM

(75) Inventors: Takashi Kurumisawa, Shiojiri (JP); Masanori Ishida, Kagoshima (JP); Kiyoaki Murai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 913 days.

(21) Appl. No.: 10/634,799

(22) Filed: Aug. 6, 2003

(65) Prior Publication Data

US 2004/0080516 A1 Apr. 29, 2004

(30) Foreign Application Priority Data

Aug. 22, 2002 (JP) ..... 2002-242479

(51) Int. Cl.
*G09G 5/10* (2006.01)

(52) U.S. Cl. ..... 345/690; 345/698

(58) Field of Classification Search ..... 345/87, 345/89, 97, 690, 691, 698, 204; 349/33, 349/173; 358/1.9; 382/201, 209
See application file for complete search history.

(56) References Cited

U.S. PATENT DOCUMENTS

| | | | | |
|---|---|---|---|---|
| 5,754,309 | A * | 5/1998 | Chen et al. | 358/3.1 |
| 5,832,414 | A * | 11/1998 | Hart et al. | 702/77 |
| 6,191,772 | B1 * | 2/2001 | Mical et al. | 345/698 |
| 6,233,366 | B1 * | 5/2001 | Ushida | 382/298 |
| 2003/0006952 | A1 * | 1/2003 | Hong | 345/89 |
| 2005/0105818 | A1 * | 5/2005 | Hoshi | 382/254 |

FOREIGN PATENT DOCUMENTS

| | | |
|---|---|---|
| JP | A 01-214898 | 8/1989 |
| JP | A 07-140928 | 6/1995 |
| JP | A 08-320925 | 12/1996 |
| JP | A 10-239662 | 9/1998 |
| JP | A 2000-194311 | 7/2000 |

* cited by examiner

*Primary Examiner*—Nitin I. Patel
(74) *Attorney, Agent, or Firm*—Oliff & Berridge, PLC

(57) ABSTRACT

The invention provides an easy and simple method of converting the resolution of image data, which is capable of generating the high-resolution image data without incongruity, does not make a circuit in the display device complicated and does not increase the power consumption. This invention can include a portable terminal device, such as a mobile telephone or a PDA, that processes and displays image data transmitted from the outside. Image data with a plurality of grayscales can be displayed by controlling the display state of each pixel in a display unit in accordance with grayscale control pulses corresponding to the number of grayscales. For example, when a 64 grayscale display is performed, a grayscale level is defined using sixty four grayscale control pulses. Thus, it is possible to emit light from pixels in the display unit by sixty four grayscale levels. Further, the resolution converting device can generate pseudo-high-resolution image data obtained by increasing the number of pixels of original image data by n multiplication and by reducing the number of grayscales of the original image data to 1/n. When displaying the pseudo-high-resolution image data, the number of grayscale control pulses is changed to 1/n by a halftone controller. That is, in the pseudo-high-resolution image data, the number of grayscales is 1/n. Therefore, the number of grayscale control pulses used for halftone display may be 1/n in accordance with the number of grayscales. Therefore, the low-resolution image data can be displayed without incongruity by converting the resolution, also, it is possible to reduce power consumption of the display unit by the reduced amount of the number of grayscale levels pulses.

7 Claims, 15 Drawing Sheets

FIG. 6

| GRAYSCALE | GRAYSCALE VALUE (ON PULSE WIDTH) |
|---|---|
| 0 | 0 |
| 1 | 13 |
| 2 | 26 |
| 3 | 36 |
| 4 | 46 |
| 5 | 58 |
| 6 | 70 |
| 7 | 82 |
| 8 | 94 |
| 9 | 103 |
| 10 | 112 |
| 11 | 134 |
| 12 | 156 |
| 13 | 206 |
| 14 | 255 |

(1 PIXEL → 16 PIXELS)

(SIXTEEN PATTERNS)

IMAGE DISPLAY DEVICE, IMAGE DISPLAY METHOD, AND IMAGE DISPLAY PROGRAM

BACKGROUND OF THE INVENTION

1. Field of Invention

The present invention relates to a method for converting the resolution of image data.

2. Description of Related Art

Recently, the screen size of display devices mounted in portable terminal devices, such as mobile telephones or PDAs (personal digital assistant) has increased and the resolution has improved. Therefore, it is possible to display high-resolution image data with a higher number of pixels on a larger screen compared to a conventional technology.

However, high-resolution image data corresponding to such a large screen display or a high resolution display (hereinafter, referred to simply as a high resolution display) has a large amount of data. Therefore, there is a problem in that communication expenses are unnecessarily high in transmitting and receiving the high-resolution image data. Also, a service provider who provides various contents to portable terminal devices must prepare the high-resolution image data in addition to image data corresponding to the size of conventional screens and must provide the high-resolution image data to users with high resolution display devices. As a result, the service provider must prepare and keep various types of image data. Therefore, there can be a problem in that development expenses and equipment costs increase.

SUMMARY OF THE INVENTION

In view of at least these points, a method of using properly image data corresponding to the size of the screen of the conventional portable terminal device and the high-resolution image data is considered. That is, in the case of a service of providing contents performed enough by using the image data corresponding to a normal screen size, the image data corresponding to the conventional screen size (hereinafter, referred to as low resolution screen data for convenience) is transmitted and received. In the case of a service of providing contents where it is requested to display a high resolution image, the high-resolution image data is transmitted and received.

When the high-resolution image data is received, a portable terminal device corresponding to high resolution displays the high-resolution image data as it is. When the low-resolution image data is received, the portable terminal device converts resolution to create the high-resolution image data without incongruity, and displays the high-resolution image data.

Resolution is generally converted by simply increasing the size of a pixel. For example, when image data with a certain number of pixels is doubled in horizontal and vertical directions, one pixel data is simply doubled in horizontal and vertical directions. That is, one pixel is converted into a set of 2×2 pixels where the same pixels are parallel to each other in horizontal and vertical directions. Thus, the number of pixels in horizontal and vertical directions is doubled. Therefore, it is possible to create high-resolution image data from the low resolution image data.

However, according to the above method of converting the resolution, because one pixel is simply enlarged, although the size of the image increases, an image can look grainy or distorted. In particular, in a region with a slope line component in an image, jaggies distinctively appear on the slope line. Also, according to a certain method of increasing the number of pixels, a problem may occur in which signal processing in a display device becomes complicated or power consumption increases.

An object of the present invention is to provide a method of converting the resolution of image data, which is simply and easily capable of creating the high-resolution image data without incongruity, does not make a circuit in the display device complicated and does not increase the power consumption. In order to achieve the above object, according to a first aspect of the present invention, there is provided an image display device having a display unit for displaying image data, a halftone controller for performing halftone display by controlling a display state of each pixel in the display by the number of grayscale control pulses corresponding to the number of grayscale levels of the image data, a resolution conversion device for multiplying the number of pixels of original image data by n and generating pseudo-high-resolution image data with the number of grayscale levels of 1/n, and a grayscale controlling device for controlling the halftone controller to convert the number of the grayscale control pulses to 1/n when displaying the pseudo-high-resolution image data.

The above image display device can include a portable terminal device, such as a mobile telephone or a PDA processes. For example, the image display device displays image data transmitted from the outside. Image data with a plurality of grayscales is displayed by controlling the display state of each pixel in a display unit in accordance with grayscale control pulses corresponding to the number of grayscales. For example, when a 64 grayscale display is performed, a grayscale level is defined using sixty four grayscale control pulses. Thus, it is possible to emit light from pixels in the display unit by sixty four grayscale levels.

Further, the resolution converting device can generate pseudo-high-resolution image data obtained by increasing the number of pixels of original image data by n multiplication and by reducing the number of grayscales of the original image data to 1/n. When displaying the pseudo-high-resolution image data, the number of grayscale control pulses is changed to 1/n by a halftone controller. That is, in the pseudo-high-resolution image data, the number of grayscales is 1/n. Therefore, the number of grayscale control pulses used for halftone display may be 1/n in accordance with the number of grayscales.

According to the above image display, an image display device capable of displaying a high resolution image can display lower resolution image data without incongruity by generating pseudo-high-resolution image data obtained by increasing the number of pixels from original image data. Also, it is possible to reduce power consumption by the display unit by the reduced amount of the number of grayscale levels pulses.

In an aspect of the present invention, the resolution conversion device can convert one pixel into one of n pixel patterns comprising 1 to n pixels of specific grayscale levels. According to the above aspect, the level of brightness visually observed by a human being varies in accordance with the number of pixels of a specific grayscale level included in a plurality of pixels after converting the resolution. Therefore, it is possible to display a plurality of grayscale levels in a pseudo manner by arranging the pixel of a specific grayscale level in a specific pixel pattern. As a result, it is possible to reduce the number of grayscales to be set by the display unit.

According to an embodiment suitable for the case, the resolution conversion device can convert one pixel into four pixel patterns of four pixels which have two pixels in each of the horizontal and vertical directions, constructed by doubling the one pixel in each of the horizontal and vertical directions. The 4 pixel patterns have a first pixel pattern including only one pixel of the specific grayscale levels, a second pixel pattern having two pixels of the specific grayscale levels, a third pixel pattern having three pixels of the specific grayscale levels, and a fourth pixel pattern having four pixels of the specific grayscale levels.

According to another aspect of the image display, the halftone controller includes a pulse generator for generating the number of grayscale control pulses corresponding to the number of pieces of the image data, and a driver for applying a driving voltage to the pixels only for a period corresponding to the number of grayscale control pulses corresponding to the grayscale levels to be displayed. According to the aspect, when displaying the pseudo-high-resolution image data, power consumption is reduced by reducing the number of grayscale control pulses generated by a pulse generator.

According to another aspect of the image display, further includes a receiver for receiving a low-resolution image data having the number a of pixels and the number b of grayscale around a display area and a high-resolution image data having the number a×n of pixels and the number b of grayscale around the display area, wherein the grayscale controller can control the halftone controller to set the number of the grayscale pulses to b/n when displaying the pseudo-high-resolution image data, and to set the number of the grayscale pulses to b when displaying the high-resolution image data.

According to the above aspect, when the image data provided by an external device is high-resolution image data, it is possible to display high quality image using the number of all of grayscales that can be displayed by the halftone controller. In the meantime, when the low-resolution image data is provided, resolution of the image data is converted to generate the pseudo-high-resolution image data. Thus, an image is displayed without incongruity. At this time, the grayscale controlling device sets the number of grayscales of the halftone controller as b, the number of full grayscales when displaying the high-resolution image data. When displaying the pseudo-high-resolution image data, the number of grayscales is reduced to b/n to reduce the power consumption and to display an image without incongruity.

According to another aspect, an image display method to be executed in an image display device including a display unit for displaying image data, the image display method includes a resolution conversing process for multiplying the number of pixels of original image data by n and generating pseudo-high-resolution image data with the number of grayscale levels of 1/n, and halftone display step for performing halftone display by controlling a display state of each pixel in the display unit by the number of grayscale control pulses corresponding to the number of grayscale levels of the image data to be displayed. The halftone display step changes the number of the grayscale control pulses to 1/n when displaying the pseudo-high-resolution image data.

According to the above image display method, the image display capable of displaying the high resolution image can display lower resolution image data without incongruity by generating the pseudo-high-resolution image data obtained by increasing the number of pixels from original image data using the image display. Also, it is possible to reduce power consumption in the display unit as much as the reduced amount of the number of grayscale levels pulses.

According to another aspect of the present invention, an image display program to be executed in an image display device including a display unit for displaying image data, can include a resolution converting step for multiplying the number of pixels of original image data by n and generating pseudo-high-resolution image data with the number of grayscale levels of 1/n, and halftone display step for performing halftone display by controlling a display state of each pixel in the display by a grayscale control pulse of the number corresponding to the number of grayscale levels of the image data to be displayed. The halftone display step changes the number of the grayscale control pulses to 1/n when displaying the pseudo-high-resolution image data.

According to the above image display program, the image display capable of displaying the high resolution image can display lower resolution image data without incongruity by generating the pseudo-high-resolution image data obtained by increasing the number of pixels from original image data using the image display. Also, it is possible to reduce power consumption in the display unit by the reduced amount of the number of grayscale levels pulses.

BRIEF DESCRIPTION OF THE DRAWINGS

The invention will be described with reference to the accompanying drawings, wherein like numerals reference like elements, and wherein:

FIG. 6 is a table showing the relationship between grayscale value and a pulse width in ON-period;

DETAILED DESCRIPTION OF PREFERRED EMBODIMENTS

Preferable embodiments of the present invention will now be described with reference to the drawings.

Figure 1:
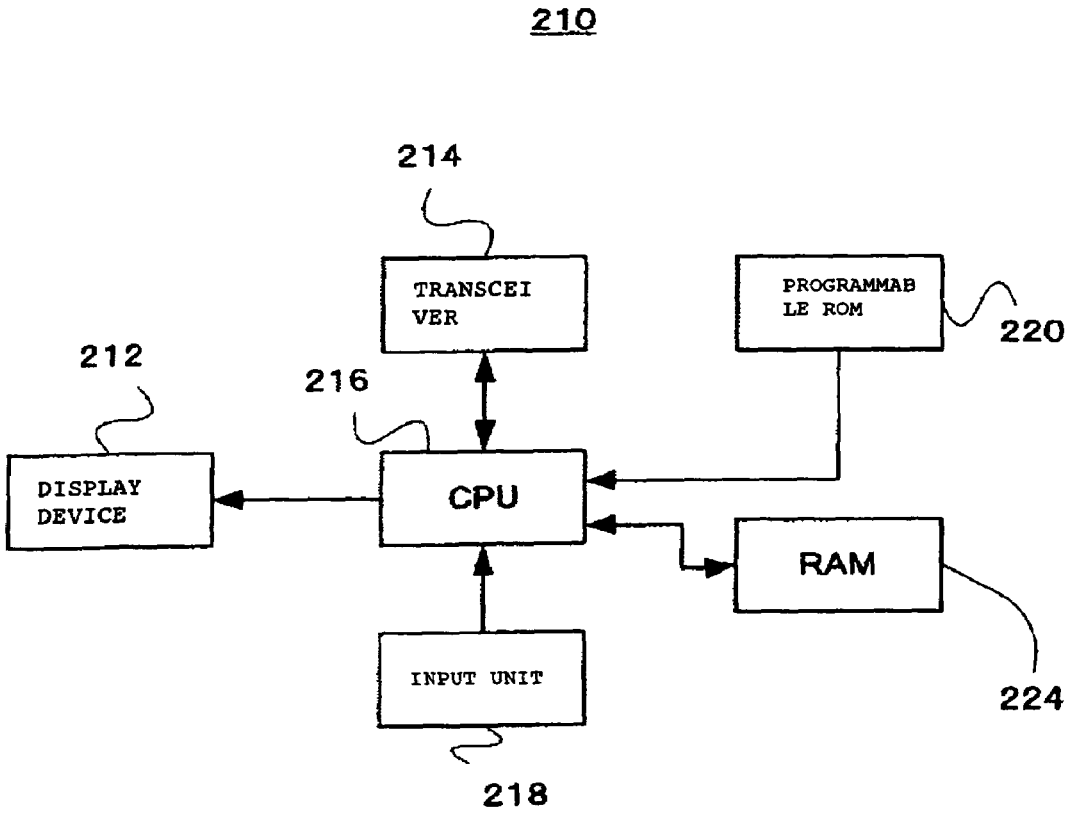
FIG. 1 shows an exemplary schematic construction of a portable terminal device to which a resolution conversion process of the present invention is applied.

FIG. 1 illustrates an exemplary schematic structure of a portable terminal device, to which a resolution converting method according to an embodiment of the present invention can be applied. In FIG. 1, a portable terminal device 210 is a terminal device, such as a mobile telephone or a PDA. The portable terminal device 210 can include a display device 212, a transceiver 214, a CPU 216, an input unit 218, a programmable ROM 220, and a RAM 224.

The display device 212 may be a light and thin display device, such as a LCD (liquid crystal display) and displays image data in a display area. The display device 212 can display a high resolution image where the number of pixels in horizontal and vertical directions is, for example, 240×320 dots.

The transceiver 214 receives image data from the outside. For example, a user manipulates the portable terminal device 210 to connect to a server device or the like for performing a service of providing contents, input a command of downloading desired image data, and then image data is received. Also, in the case of receiving face image data from the portable terminal device of another user, the transceiver 214 receives the image data. The image data received by the transceiver 214 can be stored in the RAM 224.

The input unit 218 may include various manipulation buttons in the case of the mobile telephone and a tablet for detecting contact by a touch pen in the case of the PDA and is used for a user to perform various commands and selections. The commands and the selections input by the input unit 218 are converted into electrical signals and are sent to the CPU 216.

The programmable ROM 220 stores various programs for executing various functions of the portable terminal device 210. In particular, in the present embodiment, the programmable ROM 220 stores an image display program for displaying image data on the display device 212 and a resolution conversion program for converting the low-resolution image data into the high-resolution image data and displaying the high-resolution image data on the display device 212.

The RAM 224 is used as a working memory when the low-resolution image data is converted into the high-resolution image data according to the resolution conversion program. Also, as mentioned above, the image data received from the outside by the transceiver 214 may be stored if necessary.

The CPU 216 executes various programs stored in the programmable ROM 220 for executing various functions of the portable terminal device 210. In particular, according to the present embodiment, the CPU 216 reads and executes the resolution conversion program stored in the programmable ROM 220 to convert the low-resolution image data into the high-resolution image data. Further, the CPU 216 reads and executes the image display program stored in the programmable ROM 220 to display image data (including the low-resolution image data and the high-resolution image data) on the display device 212. Furthermore, the CPU 216 executes various programs other than the above programs for realizing various functions of the portable terminal device 210. However, because these functions are not directly related to the present invention, description thereof will be omitted.

Hereinafter, for convenience's sake, the image data corresponding to the conventional screen size of about 120×160 pixels in horizontal and vertical directions is called as the low resolution image data. The image data corresponding to the screen size of about 240×320 pixels in horizontal and vertical directions is called the high-resolution image data. Also, the image data corresponding to the screen size of about 240×320 pixels obtained by converting the low resolution data based on the resolution converting method according to the present invention is called as the pseudo-high-resolution image data.

The structure of the display device 212 will now be described in greater detail. According to the present embodiment, the display device 212 is a display device using a liquid crystal panel called a two-terminal element type active matrix or a TFD (thin film diode). In the liquid crystal panel, scanning electrodes are formed on one substrate between two substrates that face each other. Signal electrodes are formed on the other substrate. A liquid crystal layer is sealed between both substrates. An element whose current-voltage characteristic is non-linear is located between the liquid crystal layer and the scanning electrode or between the liquid crystal layer and the signal electrode. A ceramic varistor and an amorphous silicon PN diode are used as the non-linear two-terminal element.

Figure 2:
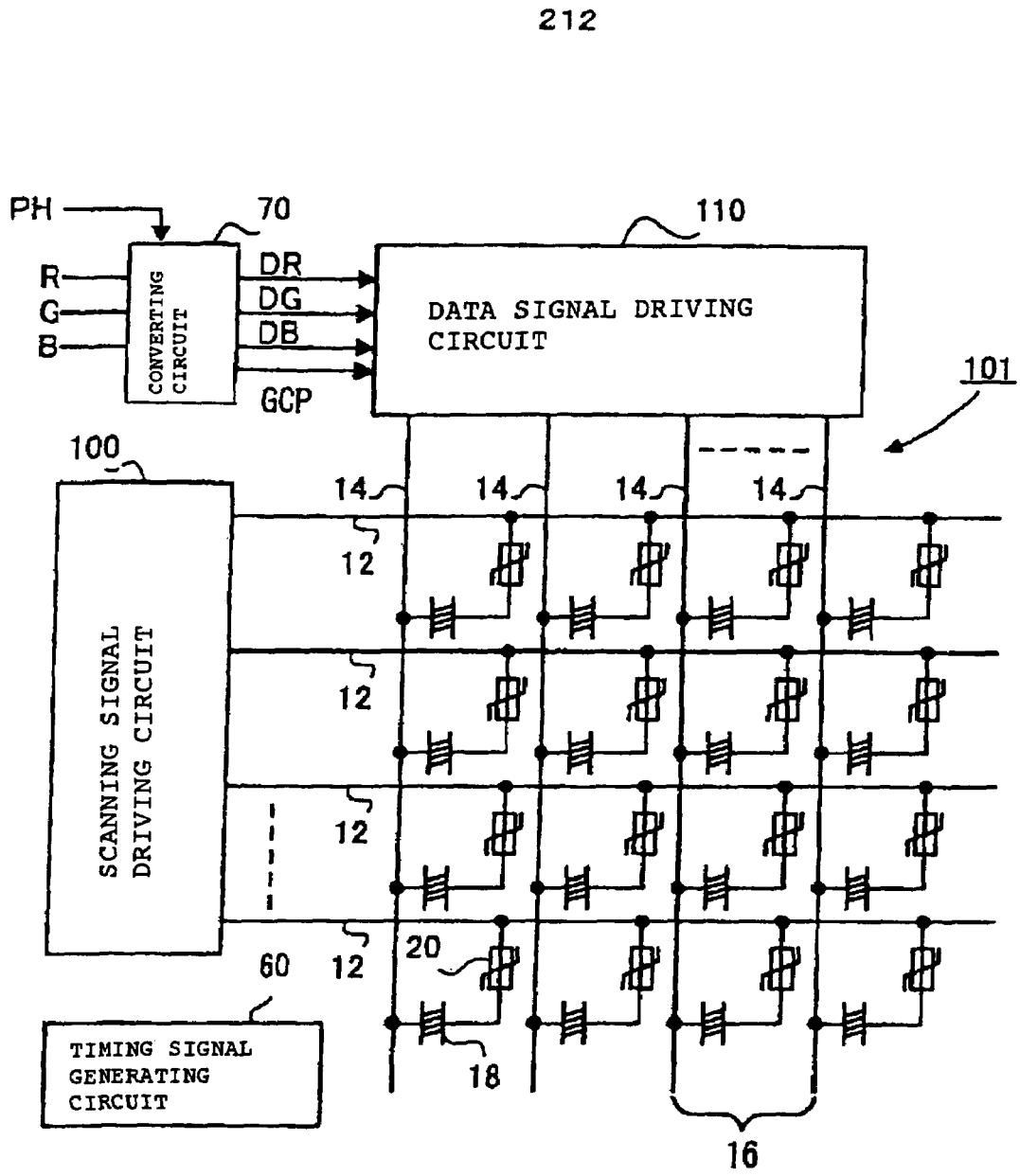
FIG. 2 is an exemplary block showing electric construction of a liquid crystal panel consisting a display device of the portable terminal device.

The structure of the display device 212 is illustrated in FIG. 2. In FIG. 2, the display device 212 can include a liquid crystal panel 101, a scanning signal driving circuit 100, a data signal driving circuit 110, a timing signal generating circuit 60, and a converting circuit 70. The timing signal generating circuit 60 outputs various timing signals for driving various components illustrated in FIG. 2.

Figure 3:
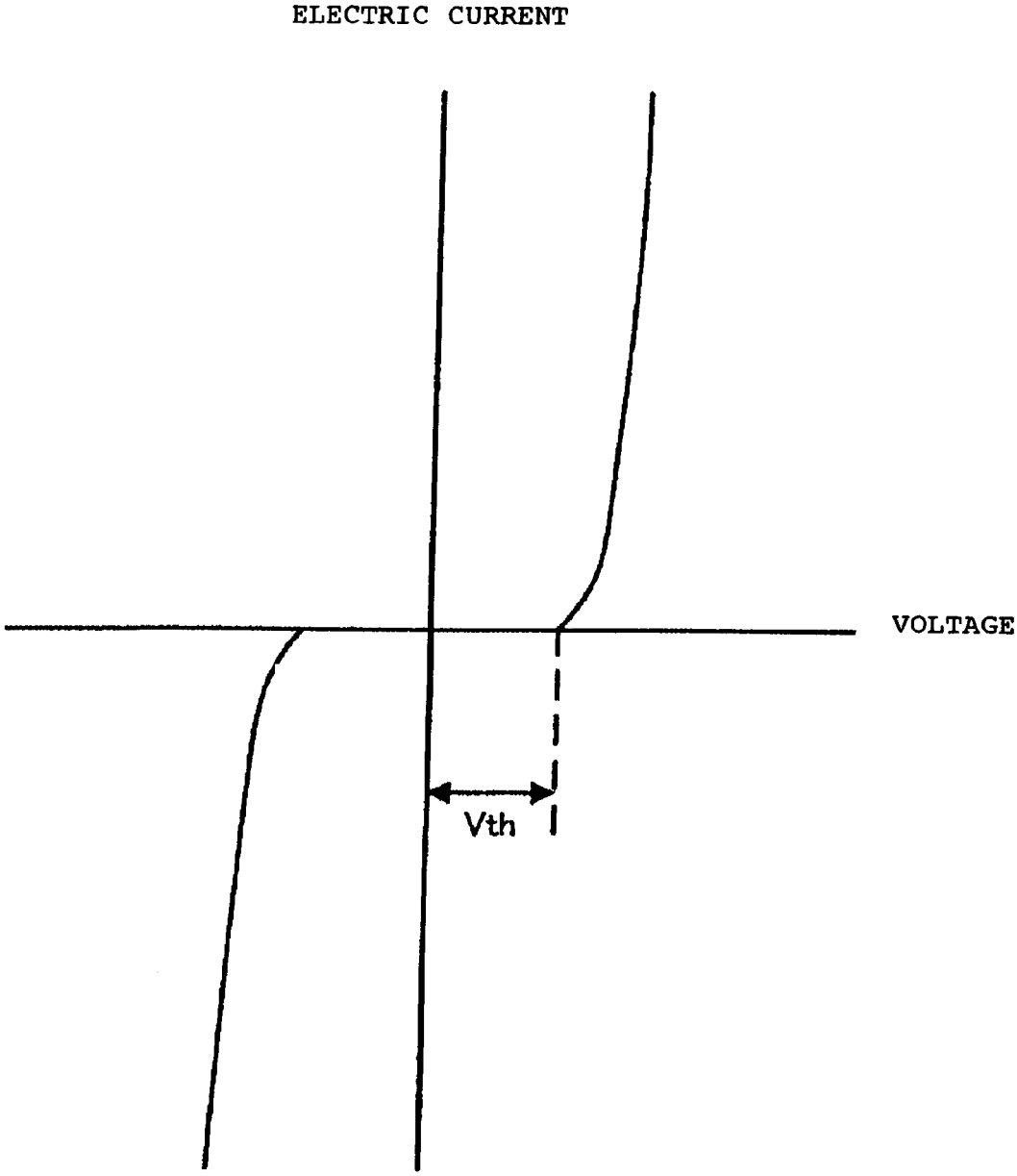
FIG. 3 is a characteristics view of a non-linear two terminal element.

The liquid crystal panel 101 can include a plurality of scanning electrodes 12 extended in a row direction and a plurality of signal electrodes 14 extended in a column direction. At each intersecting portion of the electrodes 12 and 14, a nonlinear two-terminal element 20 is connected with a liquid crystal layer 18 in series so that a pixel is formed at the every intersection portion. The liquid crystal display unit (panel) 101 is constructed by the above-described components. The nonlinear two-terminal element 20, for example, shows the current-voltage characteristics as shown in FIG. 3. In FIG. 3, the electric current hardly flow nearby the point where the voltage is zero (0), but if the absolute value of the voltage exceeds the threshold voltage Vth, the electric current increases rapidly as the voltage increases.

Figure 4:
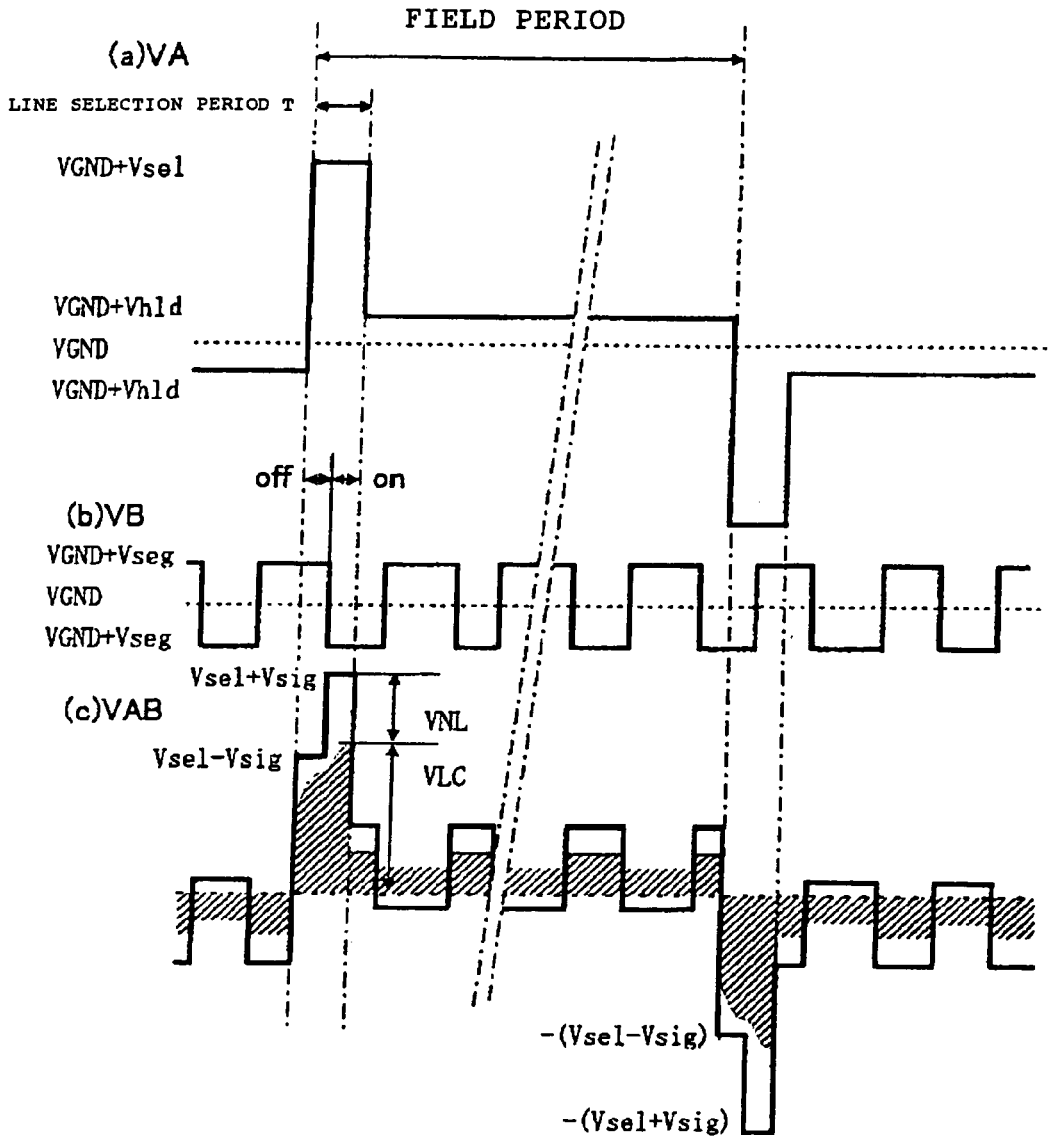
FIG. 4 is a waveform chart of each portion of the liquid crystal.

The scanning signal driving circuit 100 applies a scanning electric potential VA to the scanning electrodes 12, and the data signal driving circuit 110 applies a signal electric potential VB to the signal electrodes 14. Hereinafter, the electric potentials VA and VB are described by referring FIG. 4. First, as shown in FIG. 4(*a*), the scanning electric potential VA is applied to the scanning electrodes 12. For every line selection period T, each scanning electrode 12 is selected sequentially, and a certain electric potential having an electric potential difference of ± Vsel with respect to a common electric potential VGND, that is, an electric potential having a voltage is applied. The voltage Vsel is called as a selection voltage. After the selection, any electric potential having a voltage of ± Vhld with respect to the common electric potential VGND is applied. Here, when the electric potential in case of the selection is VGND+Vsel, a potential of VGND+Vhld is applied, and a potential of VGND−Vhld is applied when the selection potential is VGND−Vsel. The voltage Vhld is called a holding voltage. A period when all of the scanning electrode are selected to finish the selection for whole one period is called a field period. During the next field period, the scanning electrodes are selected in turn by using selection electrodes of the characteristics contrary to those of the former field period.

Meanwhile, as shown in FIG. 4(*b*), any electric potential having a voltage of ± Vseg with respect to the common electric potential VGND is applied to the signal electrodes 14. Here, when an electric potential being applied to a scanning electrode selected during a certain selection period is VGND+Vsel, VGND−Vsig and VGND+Vsig are used as an ON-electric potential Von and an OFF-electric potential Voff, respectively. When an electric potential being applied to a scanning electrode selected during a certain selection period is VGND−Vsel, VGND+Vsig and VGND−Vsig are used as the ON-electric potential Von and an OFF-electric potential Voff, respectively.

In other words, a waveform in each line selection period T of the signal electric potential VB are set to be suitable to the grayscale of every pixels in the column in accordance with the corresponding signal electrodes 14. Howerever, first of all, the signal electric potential VB is divided into an ON-period and an OFF-period for every line selection period T, so that the signal electric potential VB is set to the ON-electric potential Von for the ON-period and to the OFF-electric potential Voff for the OFF-period. Namely, the signal electric potential VB is pulse-width modulated in accordance with the grayscale value. The grayscale to be given to the pixel is higher (brighter in a normally-black mode), the ratio occupied by the ON-period is set greater.

Next, a voltage VAB between the scanning electrodes 12 and the signal electrodes 14 is depicted by a solid line in FIG. 4(*c*). As shown in the figure, the absolute value of the voltage VAB between the electrodes can be seen to be higher in the selection period of the corresponding pixel. A voltage VLC of liquid crystal layer being applied to the liquid crystal layer 18 is depicted by a hatching line in FIG. 4(*c*). Since the capacity formed by the liquid crystal layer 18 should be charged or discharged when the liquid crystal layer voltage VLC varies, the liquid crystal layer voltage VLC varies in transient response. Moreover, as shown in FIG. 4(*c*), a voltage VNL is a difference between the voltage VAB between the electrodes and the liquid crystal layer voltage VLC, that is a terminal voltage of the nonlinear two-terminal element 20.

Figure 5:
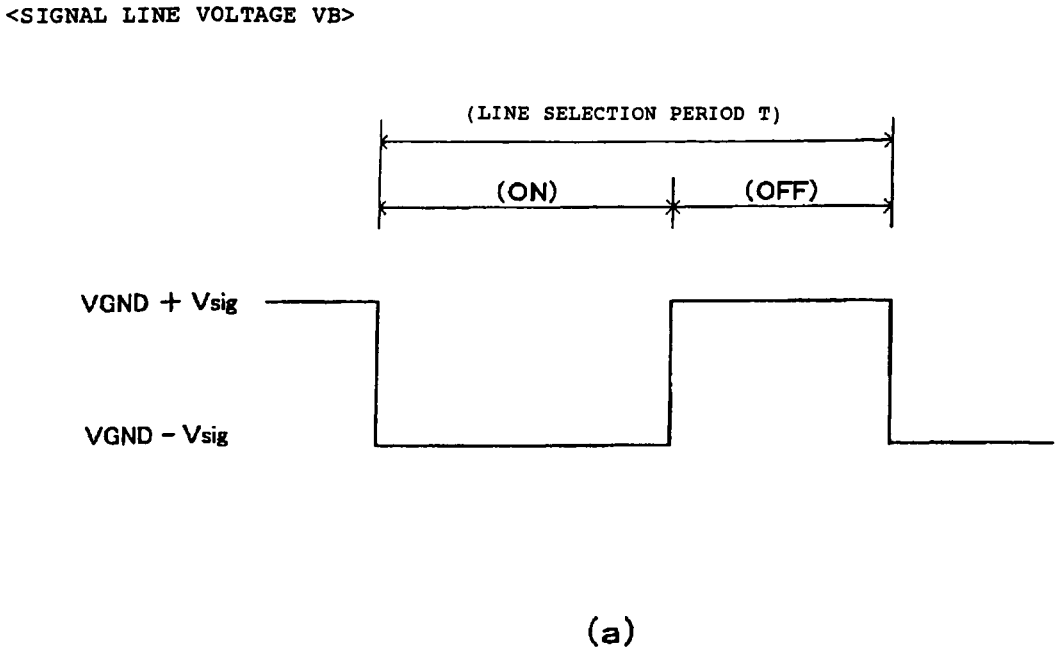
FIG. 5 is a waveform chart of a signal line electric potential VB and a voltage VAB.
Figure 5:
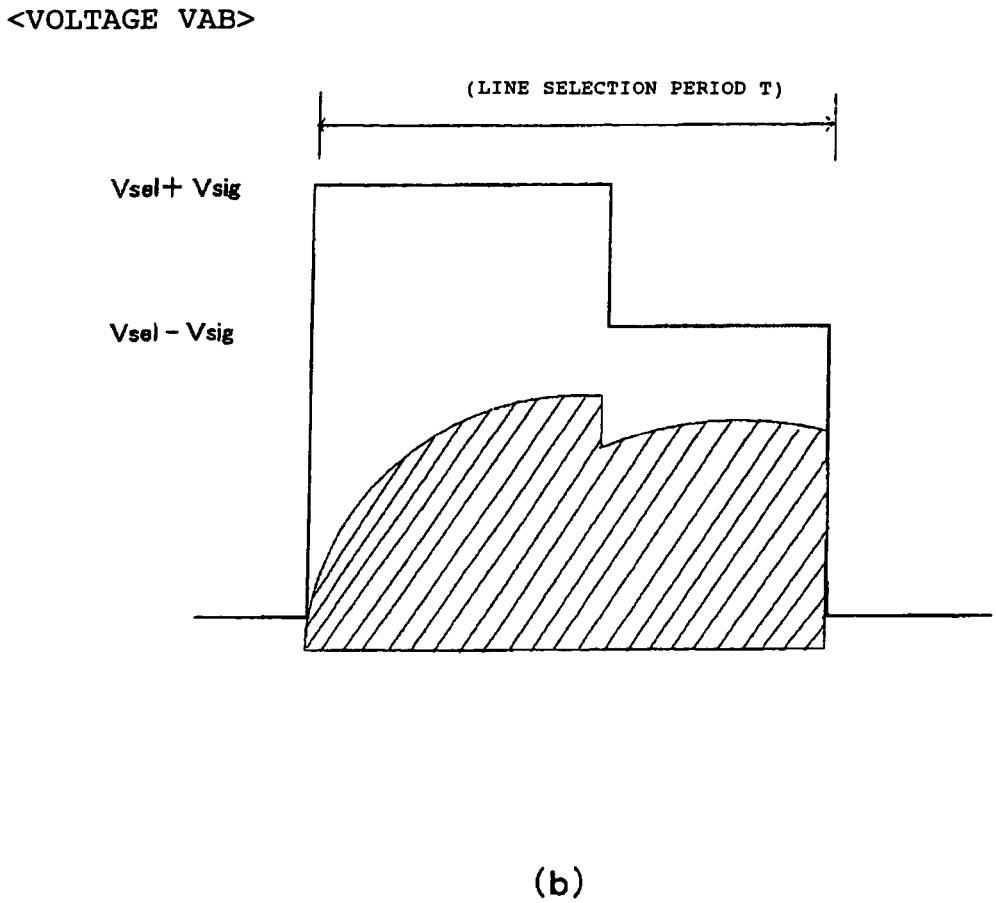

An example of the signal electric potential VB in the present embodiment is illustrated in FIG. 5(*a*). In FIG. 5(*a*), the line selection period T is formed by the ON-period and the OFF-period. Since the scanning electric potential VA is like that illustrated in FIG. 4(*a*), the voltage VAB between the electrodes and the liquid crystal layer voltage VLC are like those illustrated in FIG. 5(*b*).

Conversion circuit 70, for example, converts color image signals R, G, and B inputted from the CPU 216 into data signals DR, DG, and DB. More especially, when the color image signals R, G, and B are provided, the converting circuit 70 stores the provided color image signals R, G, and B in a line buffer (Not shown), and converts the color image signals R, G, and B into the data signals DR, DG, and DB to provide to the data signal driving circuit 110. Here, the grayscale value of each color of the color image signals R, G, and B is a value in ranges "0" to "14", and is converted into the grayscale value in the line selection period T.

Moreover, the converting circuit 70 provides a clock signal GCP to the data signal driving circuit 110. A method of generating the clock signal GCP is described. In the converting circuit 70, a basic clock signal for dividing the line selection period T by 255 is generated. Next, the basic clock signal is counted by a 8-bit (maximum 255) counter. If the counting result is a predetermined value, one pulse of the clock signal GCP is outputted. The predetermined value corresponds the grayscale value (0, 13, 26, . . . , 255) shown in FIG. 6. Moreover, the counting value when the one pulse of the clock signal GCP is outputted is set to maintain the linearity in accordance with the grayscale characteristics of the liquid crystal panel 101.

In FIG. 6, if the grayscale value is 0, the width of the ON-period is also 0 and whole period of the corresponding line selection period is the OFF-period. If the grayscale value is higher, the ratio occupied by the ON-period (the number of basic clock signal) is greater. For the grayscale value of 14, the ON-period is set to 255 so that whole period of the corresponding line selection period is the ON-period.

Figure 7:
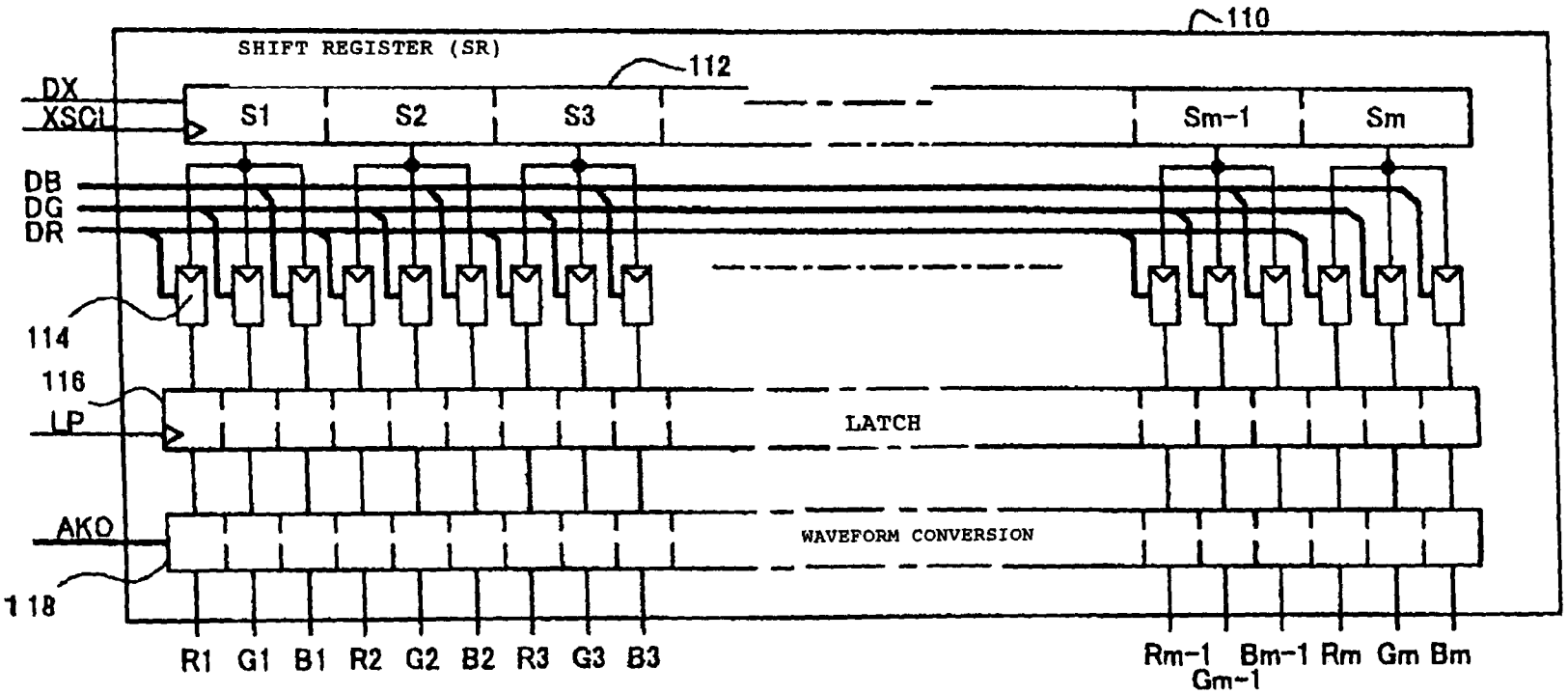
FIG. 7 is an exemplary circuit diagram of a data signal driving circuit.
Figure 8:
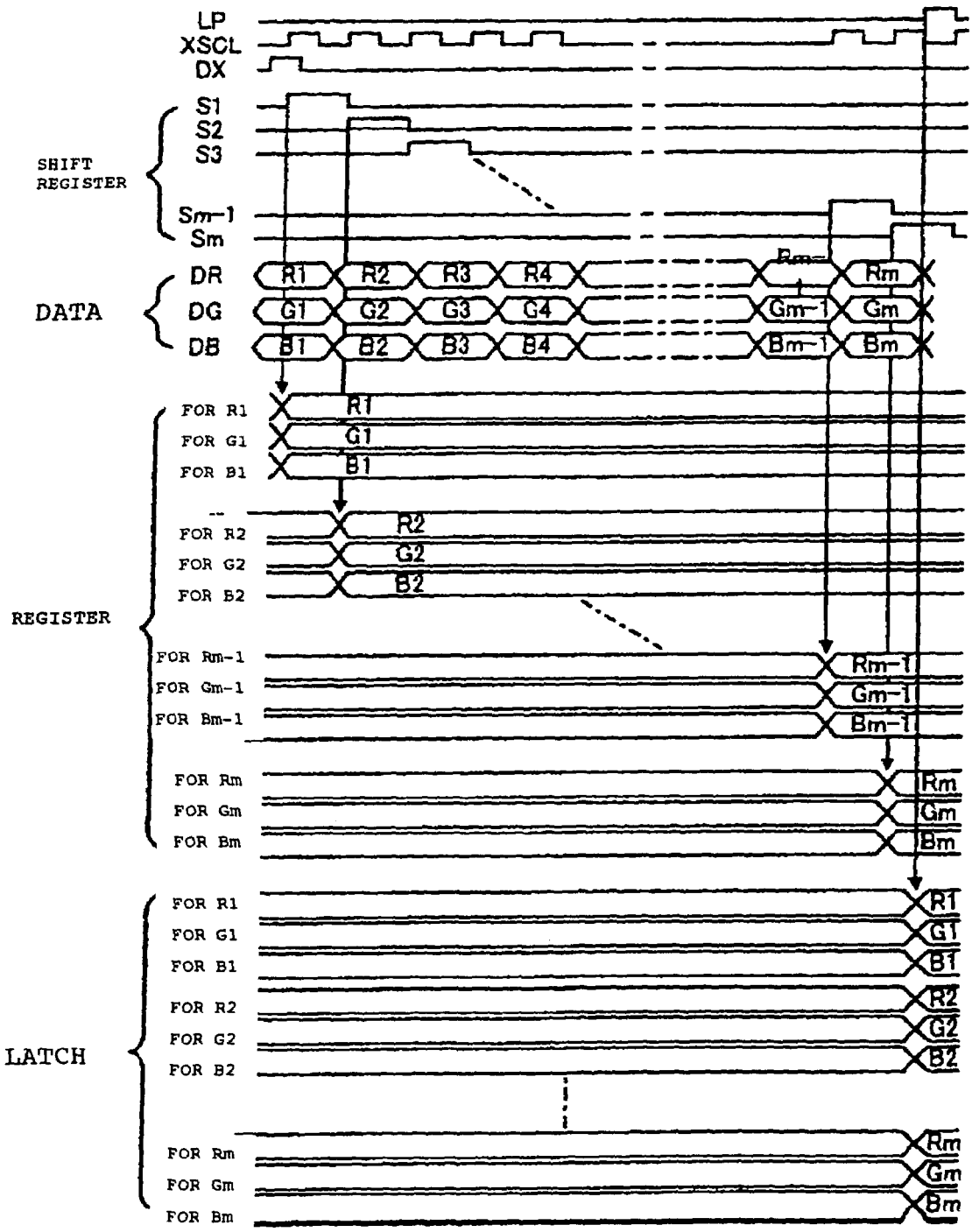
FIG. 8 is a timing chart when driving a liquid crystal panel.

Next, the construction of the data signal driving circuit 110 will be described by referring FIG. 7. A shift register 112 in the data signal driving circuit 110 is a "m/3" bit shift register (m is the number of the signal electrodes 14). The shift register 112 shifts the contents of each bit to a bit adjacent to a right-hand side whenever the pixel clock XSCL is provided. As shown in FIG. 8, the pixel clock XSCL is a down signal being synchronized to timing when each pixel data signal DR, DG, and DB is provided. A pulse signal DX is provided to an end bit of left-hand side of the shift register 112. The pulse signal DX is a one-shot pulse signal that is generated when outputs of the data signals DR, DG, and DB of the line selection period T are started from the converting circuit 70. Thus, signals S1 to Sm outputted from each bit of the shift register 112 become signals of sequential and exclusive H-level in a period equal to the cycle of the pixel clock XSCL.

A register 114 latches the data signals DR, DG, and DB by three pixels by synchronizing with each start of the output signals S1 to Sm of the shift register 112. A latch circuit 116 synchronizes with a first start of a latch pulse LP, and then latches all of the data signals stored in the register 114 simultaneously. A waveform converting section 118 converts the latched data signal into the signal electric potential VB shown in FIG. 5(*a*) to apply to the m signal electrodes. Namely, the output timing of the latch pulse LP becomes a starting timing of the line selection period T.

Figure 9:
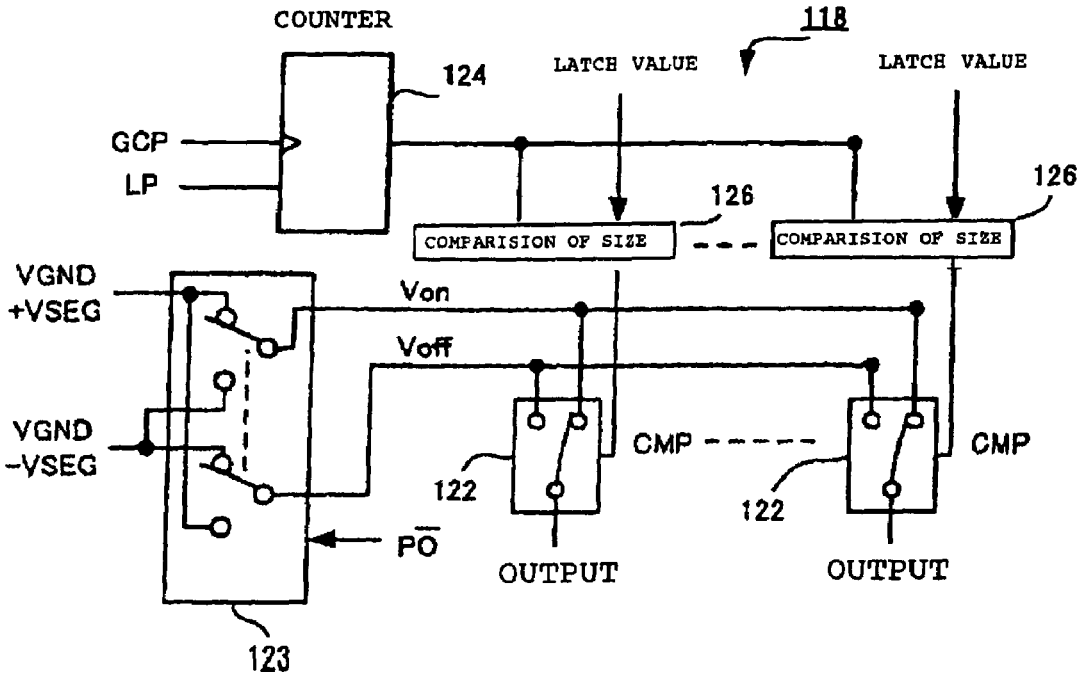
FIG. 9 is an example of a circuit of a waveform conversion unit.

Next, FIG. 9 shows an example of the waveform converting section 118. In FIG. 9, a counter 124 is a counter installed in common for all of the signal electrodes 14, whose counting value is reset to 0 when a first start of the latch pulse LP to count the clock signal GCP. A comparator 126 compares data signals DR, DG, and DB of each pixel latched by the latch circuit 116 with the counting value of the counter 124. Then, the comparator 126 outputs a comparing signal CMP of H-level when the counting value is less than the value of the data signal, and outputs the comparing signal of L-level when the counting value is equal to or greater than the value of the data signal. A switch 122 selects the ON-electric potential Von when the corresponding comparing signal CMP is H-level and selects the OFF-electric potential when the corresponding comparing signal CMP is L-level so that the switch 122 outputs the selected electric potential as the signal electric potential VB.

Next, the resolution converting step according to the present invention will be described. The resolution converting step is a process for generating pseudo-high-resolution image data by increasing the number of pixels of the low resolution image data. For example, there is assumed 64 grayscale image data with 120×160 pixels (in horizontal direction×vertical direction) as low resolution image data. In the resolution converting step, the low-resolution image data is converted into 64 grayscale pseudo-high-resolution image data with 240×320 pixels doubled in horizontal and vertical directions.

At the example, the one low-resolution image data is converted into 2×2 pixels in horizontal and vertical directions, that is 4 pixels by being enlarged as large as twice. Such a converting method is depicted schematically in FIG. 10. If an original pixel is simply enlarged into four pixels, when a certain pixel is enlarged into 2×2 pixels, all of four pixels after the enlargement has the same grayscale level. For example, if one pixel of a certain first gray level (□) is simply enlarged into four pixels, all of the four pixels becomes the first grayscale level (□), and if one pixel of a second grayscale level (■) which is different grayscale level is simply enlarged into 4 pixels, all of the four pixels becomes the second grayscale level (■). However, in this case, since, the size of the pixel is irregular, jaggies may occur in the portions of slope line of the image data.

Figure 10:
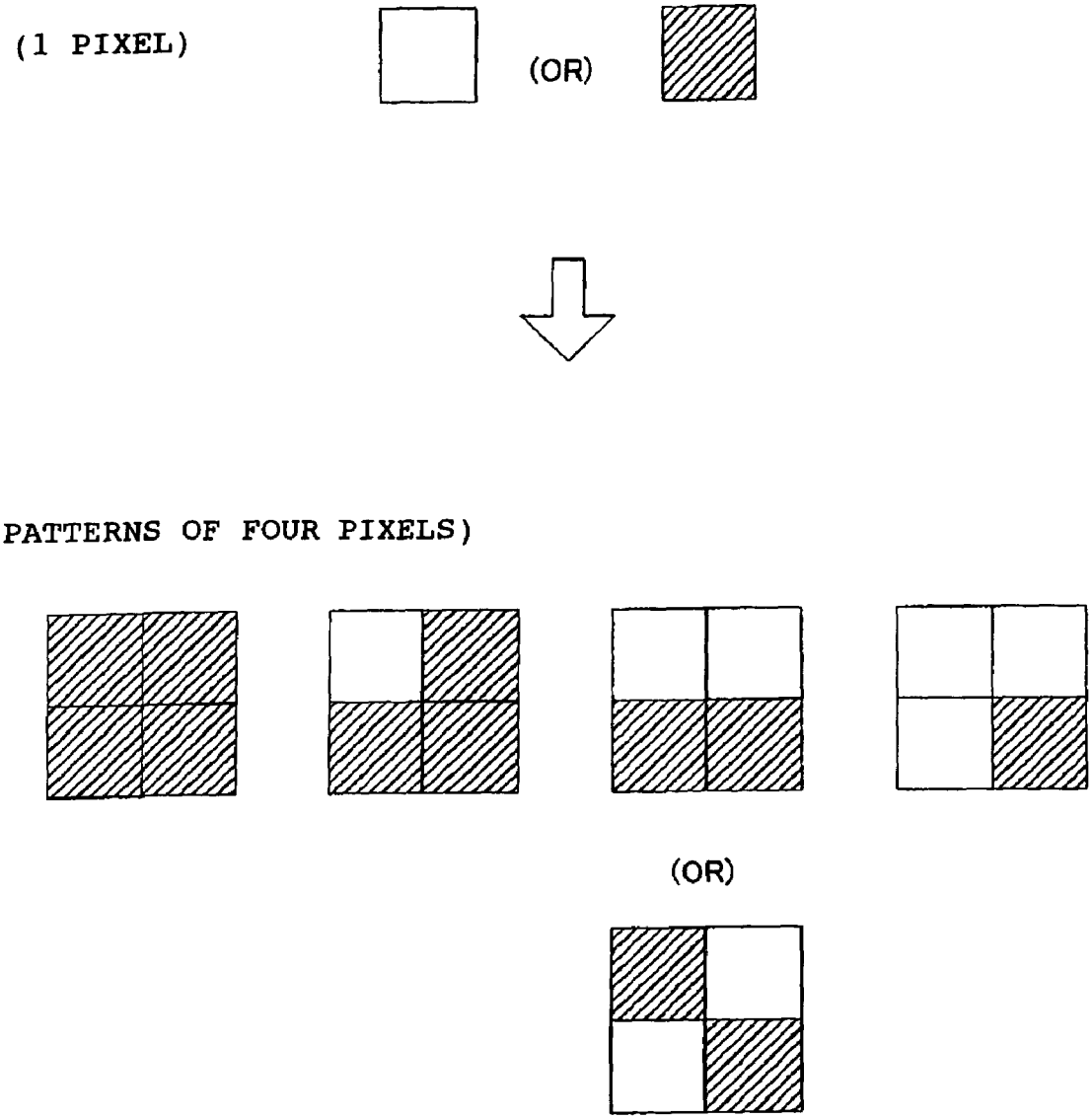
FIG. 10 shows an example of a pixel enlarging method in the resolution conversion process.

To the contrary, in the resolution converting step according to the present invention, as shown in FIG. 10, one pixel is converted into one of patterns P1 to P4 including four pixels. Namely, in the pattern P1, all of four pixels are in the second grayscale level. In the pattern P2, one pixel is in the first grayscale level, and the remaining three pixels are in the second grayscale level. In the pattern P3, two pixels are in the first grayscale level and the remaining two pixels are in the second grayscale level. In the pattern P4, three pixels are in the first grayscale level and the remaining one pixel is in the second grayscale level.

As describe above, when the four pixels after resolution conversion are allocated into four different patterns P1 to P4, since the size of one pixel is small, each of the patterns P1 to P4 is visually observed as four different grayscales by human being. Namely, by using the first and the second grayscale levels only, the four grayscales can be represented in a pseudo manner. And thus, the effect of jaggies can be decreased. In this regard, the image data obtained by increasing the number of pixels and converting resolution is called a pseudo-high-resolution image data in the view of distinguishing from the high-resolution image data of usual 240×320 pixels.

When the pseuo-high-resolution image data is displayed, the grayscale value generated by the display device 212 can be decreased. In the above embodiment, the low-resolution image data before the resolution conversion has sixty four grayscales, but the pseudo-high-resolution image data after the resolution conversion can represent four grayscales at the two grayscale levels in a pseudo manner. Thus, the display device 212 can display the grayscale value of 64/4=16, and can also display the sixty four grayscales in a pseudo manner by four patterns illustrated in FIG. 10. Namely, the display device 212 displays the pseudo-high-resolution image data after resolution conversion into sixteen grayscales.

In this regard, the number of grayscale control pulses (the number of GCP) of the clock signal GCP used in the control of the grayscale as mentioned above can be decreased. As described above, the value of grayscale of one pixel is controlled by the number of the clock signal GCP in one selection pulse period T. In order to display a certain pixel with a predetermined grayscale value, as shown in FIG. 6, the signal voltage VB is set to ON-voltage only during the time interval of the clock signal GCP of the pulse numbers corresponding to the grayscale value. Thus, for example, in case of displaying a certain pixel with sixty four grayscales, the sixty four GCPs are included in the one line selection period T.

Figure 11:
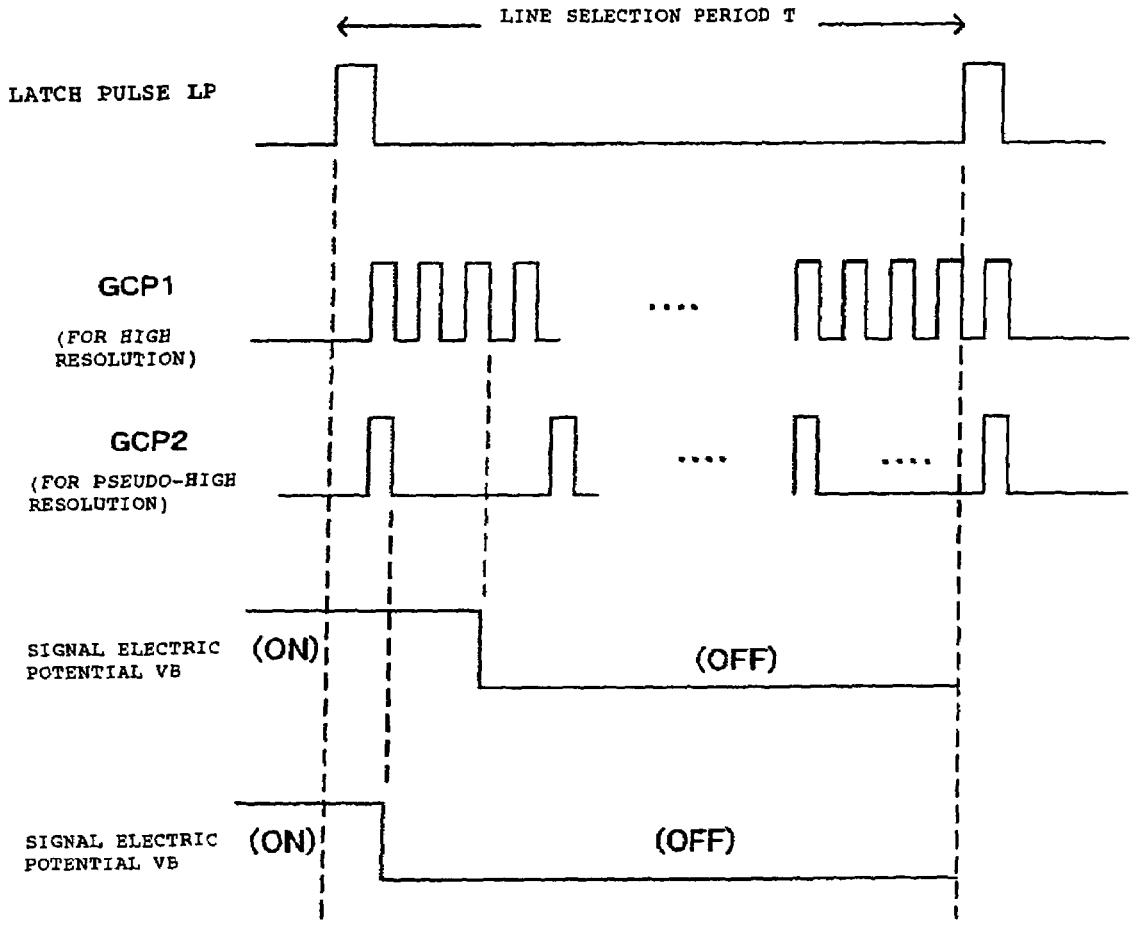
FIG. 11 is a timing chart illustrating a grayscale control method when displaying the high-resolution image data and the pseudo-high-resolution image data.

The above structure is depicted in FIG. 11. In case wherein the 64 grayscales are displayed as it is by the display device 212, the clock signal GCP1 in FIG. 11 is used. The clock signal GCP1 comprises the sixty four GCPs in the one line selection period T.

With respect to this, since the aforementioned pseudo-high resolution image can represent the four grayscales by using four types of patterns after converting resolution, the display device 212 displays sixteen grayscales so that 16×4=64 grayscales can be displayed in a pseudo manner. Thus, as shown in FIG. 11, in case of the pseudo-high-resolution image data, the display device 212 may use a clock signal GCP2 containing 16 GCPs in the one line selection period T. As a result, the number of GCPs generated in the display device 212 can be reduced (the number of GCPs can be ¼ in this example), and there is an advantage that the power consumption in the display device 212 can be reduced by the reduced numbers of the GCPs.

As described above, by using the pseudo-high-resolution image data obtained from the resolution conversion process according to the present invention, the low-resolution image data can be converted into high-resolution image data by increasing the number of pixels while maintaining the numbers of grayscale in a pseudo manner. Therefore, the power consumption of the display at that time can be reduced. Thus, in a portable terminal device capable of displaying a high-resolution image data, the pseudo-high resolution image can be displayed without incongruity by performing the resolution conversion process when receiving and displaying the low resolution image data.

Figure 13:
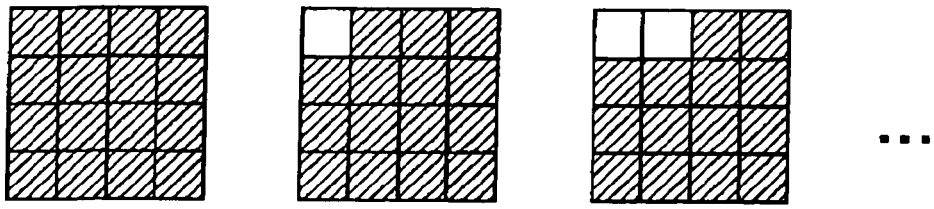
FIG. 13 shows an example of a pixel enlarging method in the resolution conversion process.
Figure 13:
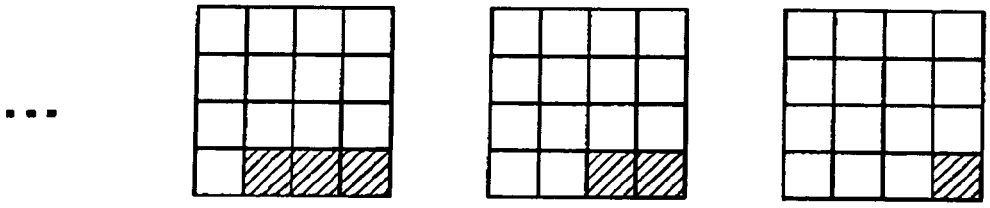

Moreover, even in the above example, as shown in FIG. 10, the resolution conversion is performed by enlarging one pixel into four pixels of 2×2, but it is not meant to limit the scope of the present invention. For example, as shown in FIG. 13, it is possible to enlarge one pixel into sixteen pixels of 4×4 (vertical×horizontal). At that time, since the patterns having sixteen pixels are sixteen as shown in FIG. 13, the sixteen grayscales can be represented in two grayscales in a pseudo manner. Thus, for example, in case where low-resolution image data before the resolution conversion has sixty four grayscales, if the resolution conversion is performed as shown in FIG. 13, it is enough for the display device 212 to display 64/14 32 4 grayscales. In this case, since in order to display the four grayscales are displayed as described above, the number of GCPs required in the one line selection period T is four, the power consumption of the display device 212 is further reduced.

At that time, for the decision of a pattern from the sixteen patterns, a 4×4 threshold matrix is used. However, since an offset value is not considered in the whole image of pixels to be applied due to synchronization to the matrix in case of multiplying by 4n, the process can be performed at a high speed. Moreover, even in case of multiplying by 2n, the process can be performed at a high speed only by determining whether a page column of the line column is even or odd.

Moreover, even though an integral number multiplication is taken in the above-described example, the resolution converting step of the present invention is not limited thereto, the integral number multiplication can be applied to non-integral number multiplication (for example, 1.3 multiplication) in principle. However, since the floating decimal operation is not performed when the integral number multiplication is set, there is an advantage that operation can be performed at a high-speed.

Next, a display control process using the resolution conversion process described above will be described. The portable terminal device 210 according to the present invention can display the high-resolution image data as it is by receiving the high-resolution image data. The portable terminal device 210 also can generate and display the pseudo-high-resolution image data by performing the resolution conversion process after receiving the low resolution image data.

When displaying the high-resolution image data as it is after receiving the same, as described above, it is necessary for the display device 212 to display the sixty four grayscales and the display device 212 uses the clock signal GCP1 as shown in FIG. 11. Meanwhile, in case of displaying the pseudo-high-resolution image data, as describe above, the clock signal GCP2 can be used. Thus, with respect to the conversion of the clock signal, it is desirable to instruct conversion between the clock signals GCP1 and GCP2 based on what kind of image data is displayed by the CPU 216 of the portable terminal device 210.

Figure 12:
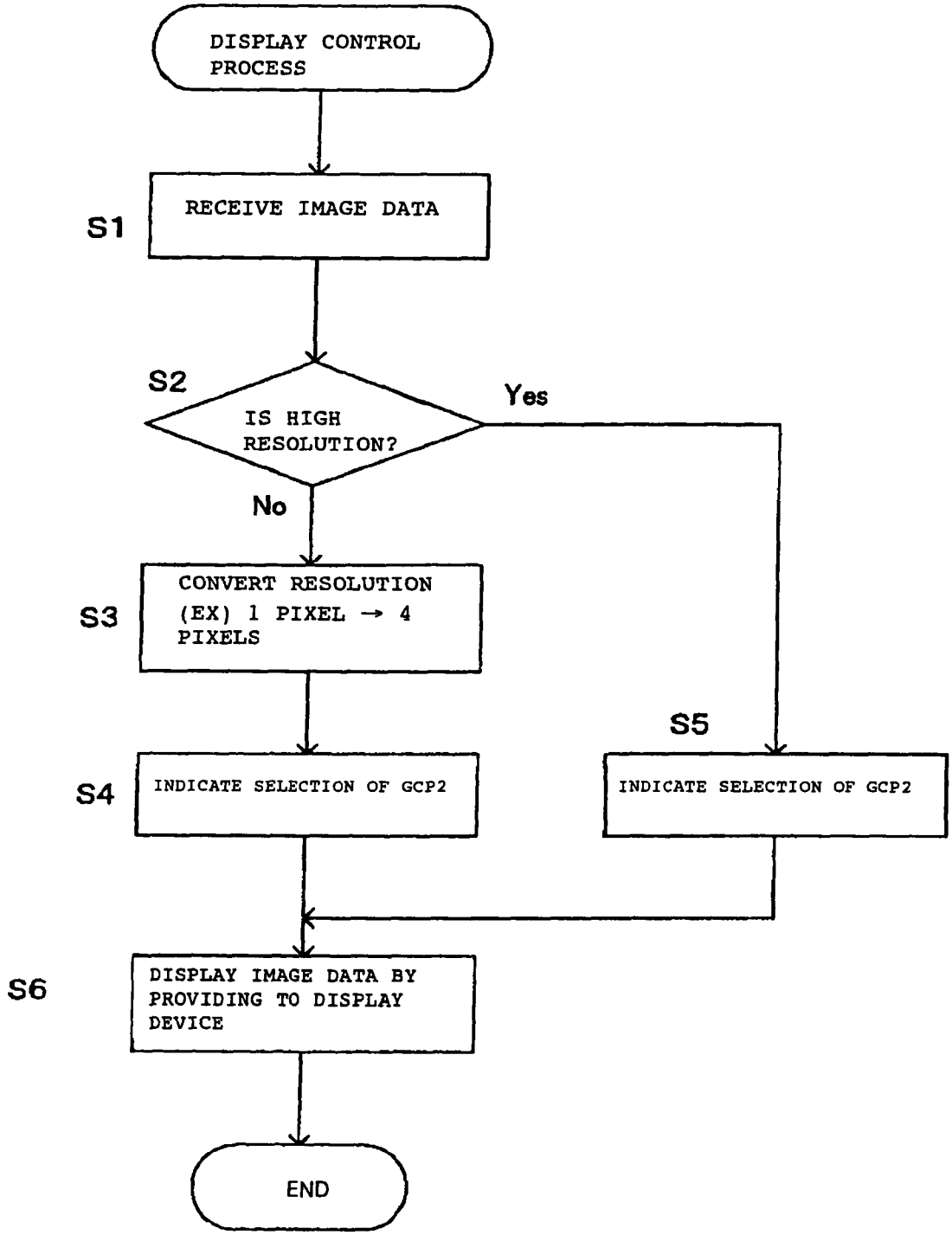
FIG. 12 is a flow chart of an exemplary display control process.

The display control process comprising the conversion is described as below by referring a flow chart of FIG. 12. The display control process depicted in FIG. 12 is essentially achieved when the CPU 216 performs a display control program stored in the programmable ROM 220.

Firstly, if the portable terminal device 210 receives the image data from external via the transceiver 214 (Step S1), the CPU 216 determines whether the received imaged data is high-resolution image data or low-resolution image data (Step S2). If determined to be the low-resolution image data (NO in Step S2), the CPU 216 performs the above-described resolution conversion process and generates the pseudo-high-resolution image data (Step S3). The CPU 216 sends control signals to the display device 212 and sets the clock signal into GCP2 (Step S4).

Moreover, when the received image data is the resolution image data (YES), the CPU 216 sends the control signal to the display device 212 and sets the clock signal into GCP1 (Step S5).

When setting of the clock signal is completed, the CPU 216 provides the image data (high-resolution image data or pseudo-high-resolution image data) to the display device 212 to display the image data (Step S6). In this regard, the portable terminal device can display the received image in accordance with the resolution.

Moreover, in the portable terminal device 210 capable of displaying the high-resolution image data, the amount of the high-resolution image data incurs high cost for communication. Thus, a case wherein all of the image data is not received as the high-resolution image data at the start can be considered. For example, it can be considered that, at first, the low-resolution image data is received and the contents thereof is grasped, and if necessary, the high-resolution image data is received, or only data of difference between the high-resolution image data and the low-resolution image data is additionally received and is finally displayed as the high-resolution image data. In this case, the CPU 216 displays the pseudo-high-resolution image data by procedures of Steps S3 to S6 at first, and after this process, displays the high-resolution image data by converting the clock signal into GCP2 by the procedure of Step S5 when the high-resolution image data or data of the difference is received.

Figure 14:
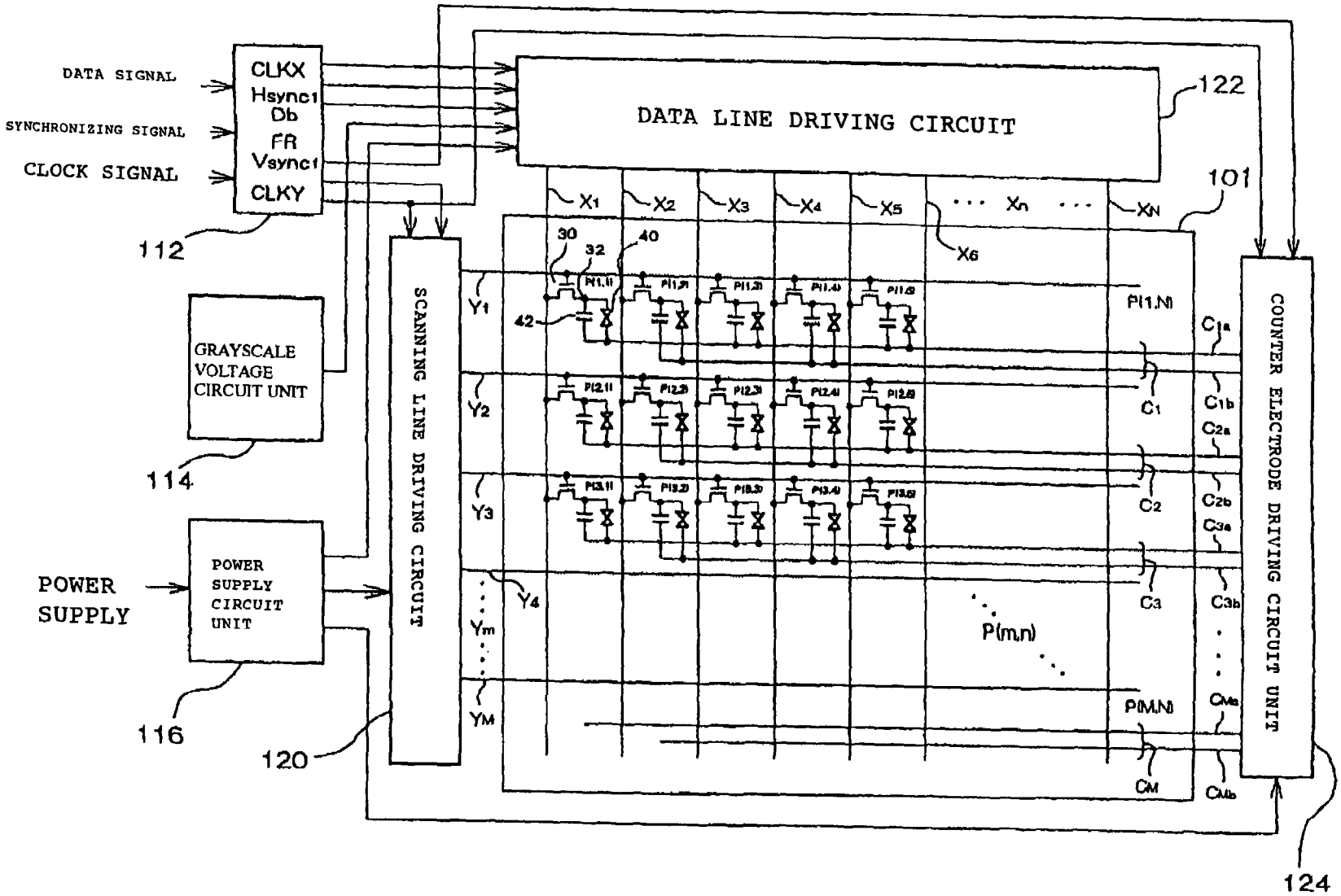
FIG. 14 shows the construction of a TFT driving circuit of the liquid crystal.

Next, an embodiment using a TFT (Thin Film Transistor) as a driving element of the liquid crystal panel of the display device 212 is described as below. FIG. 14 shows a block diagram of the liquid crystal device related to an embodiment of the present invention.

The liquid crystal device includes an liquid crystal panel 101, a signal control circuit unit 112, a grayscale voltage circuit unit 114, a power supply circuit unit 116, a scanning line driving circuit 120, a data line driving circuit 122, and a counter electrode driving circuit 124.

Data signals, synchronizing signals, and clock signals are provided to the signal control circuit unit 112. The signal control circuit unit 112 provides clock signals CLKX, horizontal synchronizing signals Hsync1, and data signals Db to the data line driving circuit 122. The signal control circuit unit 112 provides the clock signal CLKY and a vertical synchronizing signal Vsync1 to the scanning line driving circuit 120. The signal control circuit unit 112 provides a polarity reversing signal FR and the clock signal CLKY to the counter electrode driving circuit 124.

The grayscale voltage circuit unit 114 provides a reference voltage to the data line driving circuit 122. The power supply circuit unit 116 provides electric power to every device for driving the liquid crystal device.

Here, the vertical synchronizing signal Vsync1 s a signal for determining every sub-field defined by dividing one field (one frame). The polarity reversing signal FR provides a reversed-level signal to the counter electrode driving circuit 124 for every one sub-field. The clock signal CLKY is a signal for defining a horizontal scanning period S. The horizontal synchronizing signal Hsync1 is a signal outputted after every RGB data signal Db of one line portion is latched to the data line driving circuit 122 by the clock signal CLKY. Even though not shown, the signal control circuit 112 has a counter for counting the vertical synchronizing signal Vsync1, and a signal provided as the polarity reversing signal FR is determined by the result of counting.

Hereinafter, the concept of the sub-field is described. In this embodiment, a liquid crystal device shown in FIG. 14 can display eight grayscales. Namely, the data signal Db consists of 3 bit RGB. In this liquid crystal device, it is assumed that the voltages applied to the liquid crystal device, for example, are only two values of voltages V0 (L-level) and V7 (H-level). In the normally-white liquid crystal panel, if the voltage V0 is applied to the liquid crystal layer for whole period of the one field, the transmissivity becomes 100%, if applying the voltage V7, the transmissivity becomes 0%. Further, it is possible to apply a voltage corresponding to halftone to the liquid crystal layer by controlling ratio of a period of applying the voltage V0 to the liquid crystal layer to a period of applying the voltage V7 thereto. Accordingly, in order to distinguish the period of applying the voltage V0 and the voltage V7 to the liquid crystal layer, the field f is divided into seven periods. The divided periods are defined as sub-fields Sf1 to Sf7.

For example, in case where the grayscale data is (001) (in case where the grayscale display with the transmissivity of 14.3% is performed), if the voltage of the opposite electrode is 0 V, the voltage V7 is applied to the sub-field Sf1 in a selected pixel. Meanwhile, the voltage V0 is applied to the other sub-fields Sf2 to Sf7. Here, an effective value of voltage is obtained as a square root averaging the square of an instantaneous value of voltage for one period (one field). Namely, the sub-field Sf1 is set to be $(V1/V7)^2$ with respect to one field f, the effective value of voltage to be applied to the liquid crystal layer in the one field fbecomes V1.

As described above, by applying the voltage in accordance with the gray data to the liquid crystal layer by setting the sub-fields Sf1 to Sf7, the grayscale display for each transmissivity can be performed even though only two values of the voltages V0 and V7 are provided to the liquid crystal layer.

However, the signal control circuit 112 converts every the provided 3 bit RGB data signal into binary value signal Ds for the sub-fields Sf1 to Sf7. Such binary value signal Ds is provided to the data line driving circuit 122 so that one of the voltage V0 or V7 as a data signal voltage Vd is applied to the liquid crystal layer.

Figure 15:
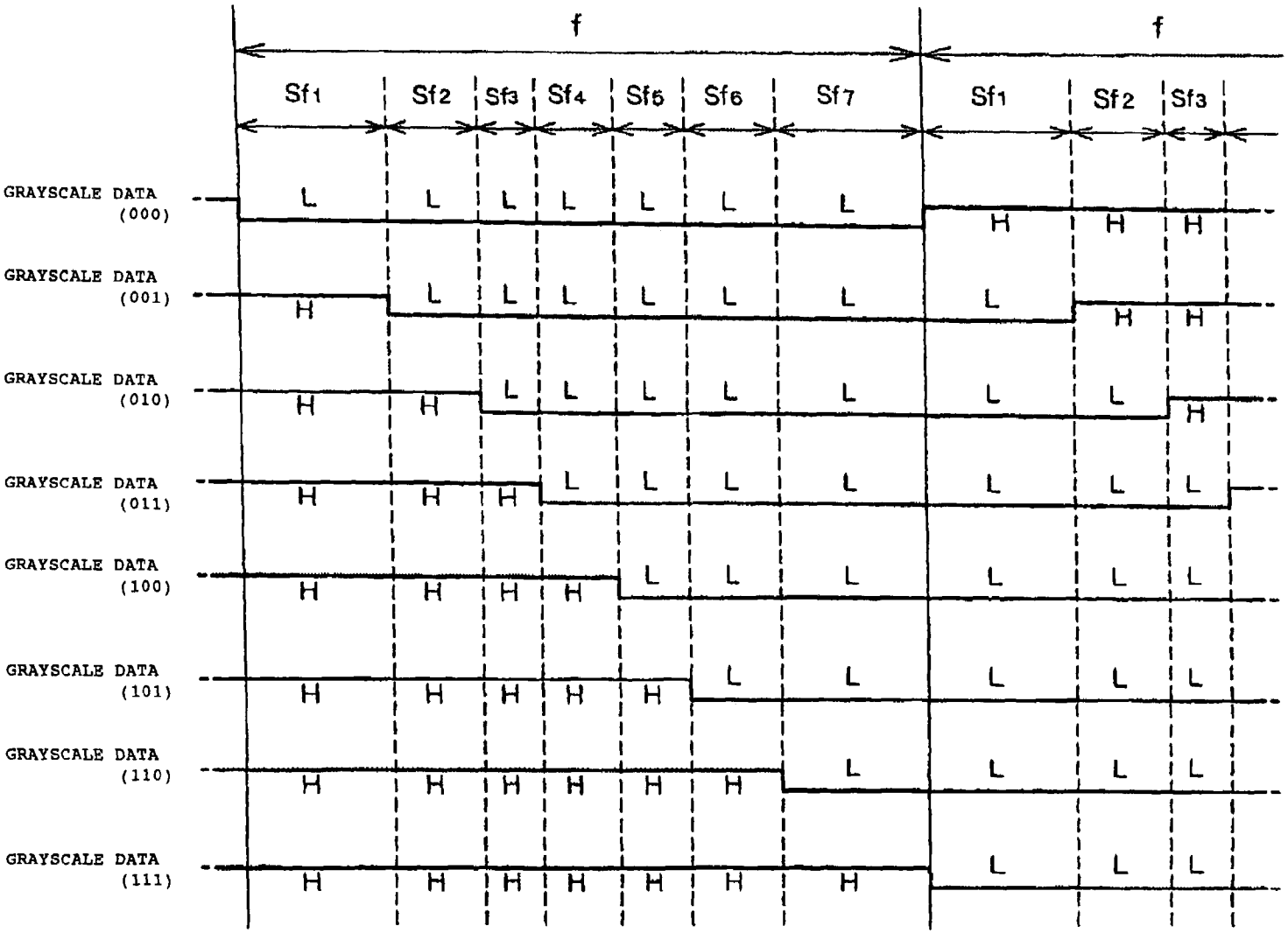
FIG. 15 is a drawing illustrating a grayscale control method by the TFT driving manner.

FIG. 15 shows voltage waveforms of the grayscale data (000) to (111) to be applied to the liquid crystal layer. In response to each grayscale data, the voltage V7 (H-level) or V0 (L-level) is applied to the liquid crystal layer for each period of the sub-fields Sf1 to Sf7. For example, in case of the grayscale data (001), (HLLLLLL) is applied to the liquid crystal layer in the order of the sub-fields Sf1 to Sf7.

In the example of the TFT driving circuit, even though the method of displaying the eight grayscales, the halftone between the sixteen grayscales and the sixty four grayscales can be displayed by setting the sub-fields Sf of the number of the grayscale similarily to a case of the eight grayscales.

Therefore, even though the display device 212 of the portable terminal device 210 drives the TFT device in PWM (Pulse Width Modulation) manner as described above, the resolution conversion process of the present invention can be applied. For example, in case wherein the above described high-resolution image data and the pseudo-high-resolution image data is displayed in conversion manner, the display device 212 is constructed to control of conversion of the sixteen grayscale display and sixty four grayscale display. In case of providing the high-resolution image data, the display device 212 performs the control of the sixty four grayscale display by writing sixty four sub-fields Sf in accordance with indication of conversion from the CPU 216. Meanwhile, in case of providing the pseudo-high-resolution image data from the CPU 216, the display device 212 performs the control of the sixteen grayscale display by writing sixteen sub-fields Sf in accordance with indication of conversion from the CPU 216. In case of the pseudo-high-resolution image data, as described above, since the four grayscale display can be performed by a plurality of patterns P1 to P4 in a pseudo manner, the sixty four grayscales can be displayed in a pseudo manner.

Moreover, even in case of using the TFT as the driving circuit of the liquid crystal panel, there is a method of controlling the halftone by not controlling the halftone by using pulse width by such a PWM drive but by controlling the number of voltage level being applied to the liquid crystal panel. For example, the halftone control of the sixty four grayscales can be achieved by applying 64 voltage levels to the pixel portions. Even in such case, since the number of the grayscales achieved in the display device is reduced in case of displaying the pseudo-high-resolution image data, the number of voltage levels being applied to the liquid crystal device can be reduced so that the low power consumption can be achieved. However, in such case, it is necessary to reduce the number of transmitting data in accordance with the state in which the number of voltage levels defining the halftone is reduced and to prepare a low power consumption mode in the electric power supply part for generating an applying voltage corresponding to the reduction of the number of the voltage level.

In the embodiments describe above, an electro optical device using the liquid crystal (LC) as an electro optical material is described as an example. For examples, well-known material comprising TN (Twisted Nematic) type, STN (Super Twisted Nematic) type, and BTN (Bi-stale Twisted Nematic) type having a twisting direction more than 180 degrees, Couple-stable type, high polymer dispersing type, and guest-host type with memorization of ferroelectric type can be used as the liquid crystal. Moreover, the present invention can be applied to an active matrix type panel using two-terminal switching devices of Thin Film Diode in addition to a three-terminal switching device of Thin Film Transistor. In addition to the above mentioned devices, the present invention can be applied to a passive matrices type panel without using the switching device. Moreover, the present invention can be applied to electro optical materials except for the liquid crystal, for examples, an electroluminescent (EL), digital micro mirror device (DMD), or various electro optical devices using a fluorescence lamp by the plasma light-emission or the electron emission.

While this invention has been described in conjunction with specific embodiments thereof, it is evident that many alternatives, modifications, and variations will be apparent in those skilled in the art. Accordingly, preferred embodiments of the invention as set forth herein are intended to be illustrative, not limiting. Various changes may be made without departing from the spirit and scope of the invention.

What is claimed is:

1. An image display device, comprising:

a display unit that displays image data;

a halftone controller that performs halftone display by controlling a display state of each pixel in the display unit by a number of grayscale control pulses corresponding to a number of grayscale levels of the image data;

a resolution conversion device that multiplies a number of pixels of original image data by n and generates pseudo-high-resolution image data with a number of grayscale levels of 1/n; and a grayscale controlling device that controls the halftone controller to change the number of the grayscale control pulses to 1/n when displaying the pseudo-high-resolution image data.

2. The image display device according to claim 1, the resolution conversion device converting a pixel into one of n pixel patterns comprising 1 to n pixels of specific grayscale levels.

3. The image display device according to claim 2, the resolution conversion device converting one pixel into four pixel patterns with four pixels which have two pixels in each of horizontal and vertical directions, constructed by doubling one pixel in each of the horizontal and vertical directions, the four pixel patterns having a first pixel pattern comprising only one pixel of a specific grayscale level, a second pixel pattern comprising two pixels of the specific grayscale level, a third pixel pattern comprising three pixels of the specific grayscale level, and a fourth pixel pattern comprising four pixels of the specific grayscale level.

4. The image display device according to claim 1, the halftone controller comprising a pulse generator that generates the number of grayscale control pulses corresponding to a number of pieces of the image data, and a driver that applies a driving voltage to the pixels only for a period corresponding to the number of grayscale control pulses corresponding to the grayscale levels to be displayed.

5. The image display device according to claim 1, further comprising:

a receiver that receives a low-resolution image data having a number of pixels a and a number of grayscale levels b near a display area and high-resolution image data having a number of pixels a×n and a number of grayscale levels b near the display area, the grayscale controller controlling the halftone controller to set the number of the grayscale pulses to b/n when displaying the pseudo-high-resolution image data, and to set the number of the grayscale pulses to b when displaying the high-resolution image data.

6. An image display method to be executed in an image display device comprising a display unit that displays image data, the image display method comprising:

multiplying a number of pixels of original image data by n and generating pseudo-high-resolution image data with a number of grayscale levels of 1/n; and performing halftone display by controlling a display state of each pixel in the display unit with a number of grayscale control pulses corresponding to the number of grayscale levels of the image data to be displayed, the number of the grayscale control pulses being 1/n when displaying the pseudo-high-resolution image data.

7. An image display program having steps to executed in an image display device comprising a display unit that displays image data, the image display program comprising:

step of multiplying a number of pixels of original image data by n and generating pseudo-high-resolution image data with a number of grayscale levels of 1/n; and the display unit controlling a display state of each pixel by performing halftone display with a number of grayscale control pulses corresponding to the number of grayscale levels of the image data to be displayed, the number of the grayscale control pulses being 1/n when displaying the pseudo-high-resolution image data.

* * * * *